United States Patent [19]

Taylor

[11] 4,096,379

[45] Jun. 20, 1978

[54] MODULAR ILLUMINATION DEVICE

[76] Inventor: Albert Taylor, 486 Kell Pl., Seaford, N.Y. 11738

[21] Appl. No.: 717,236

[22] Filed: Aug. 24, 1976

[51] Int. Cl.[2] ..... A47G 33/16; F21P 1/02

[52] U.S. Cl. ..... 362/235

[58] Field of Search ..... 240/9 R, 10 R, 10 T, 240/2 R

[56] References Cited

U.S. PATENT DOCUMENTS

| | | | |
|---|---|---|---|
| 2,344,935 | 3/1944 | Whittaker | 240/9 R |
| 2,713,629 | 7/1955 | Etzkorn | 240/10 R |
| 2,818,497 | 12/1957 | Alden | 240/9 R |
| 3,086,105 | 4/1963 | Nieder-Westermann | 240/9 R |
| 3,755,663 | 8/1973 | George | 240/10 R |

*Primary Examiner*—Monroe H. Hayes

*Attorney, Agent, or Firm*—Robert D. Farkas

[57] ABSTRACT

A modular illumination device comprising a plurality of rigid hollow illumination housings, means for separably joining each of these housings to an adjacent housing, a plurality of lamps disposed within each of the illumination housings, electrical coupling means for coupling the lamps in adjacent illumination housings, and power coupling means for coupling a power source to the plurality of lamps.

7 Claims, 4 Drawing Figures

MODULAR ILLUMINATION DEVICE

BACKGROUND OF THE INVENTION

1. Field of the Invention

The present invention relates to illumination devices, and more particularly to an illuminating device which is modular.

2. Description of the Prior Art

The decoration of homes during the Christmas holiday season has become common practice. Strings of lamps are strung around windows, doors, and along eaves. The lights are usually secured in place with staples, hooks, or the like. These light strings are frequently difficult to install, are unsightly during day light hours, and are easily damaged when stored between holiday seasons.

In an effort to overcome these problems several bulb enclosures have been proposed in the prior art. U.S. Pat. No. 3,204,090 issued to C. Kvarda, Jr. on Aug. 31, 1965 discloses a longitudinal Christmas light holder adapted to be suspended from a rain gutter. Although this device presents a neater appearance it offers little protection for the bulbs used in conjunction therewith.

U.S. Pat. No. 3,692,993 issued to S. H. Robinson on Sept. 12, 1972 teaches a light fixture having bulb sockets which are rectractable. Some protection is afforded the bulbs when stored, but they are very vulnerable to the elements when in use.

The present invention overcomes the problems associated with the prior art by providing a modular illumination device which completely encloses the bulbs used in conjunction therewith.

SUMMARY OF THE INVENTION

Therefore, it is a primary object of the present invention to provide a modular illumination device which encloses and thereby protects the bulbs used in conjunction therewith.

A further object is to provide an illumination device which is modular and is therefore readily adaptable to variously configured installations.

Another object is to provide a modular illumination device which is simple in design, inexpensive to manufacture, and durable.

These objects, as well as further objects and advantages, of the present invention will become readily apparent after reading the description of a non-limiting illustrative embodiment and the accompanying drawing.

A modular illumination device according to the principles of the present invention includes a plurality of rigid hollow illumination housings forming a chamber therein and having at least one surface thereof permitting the transmission of light therethrough; affixment means disposed on a first free end of each of the illumination housings, the affixment means for separably joining to a second free end of an adjacent illumination housing; a plurality of lamps, at least one of the plurality of lamps disposed in each of the chambers of each of the plurality of illumination housings; electrical coupling means for electrically coupling the plurality of lamps when the plurality of illumination housings are joined; and power coupling means for coupling a power source to the plurality of lamps.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
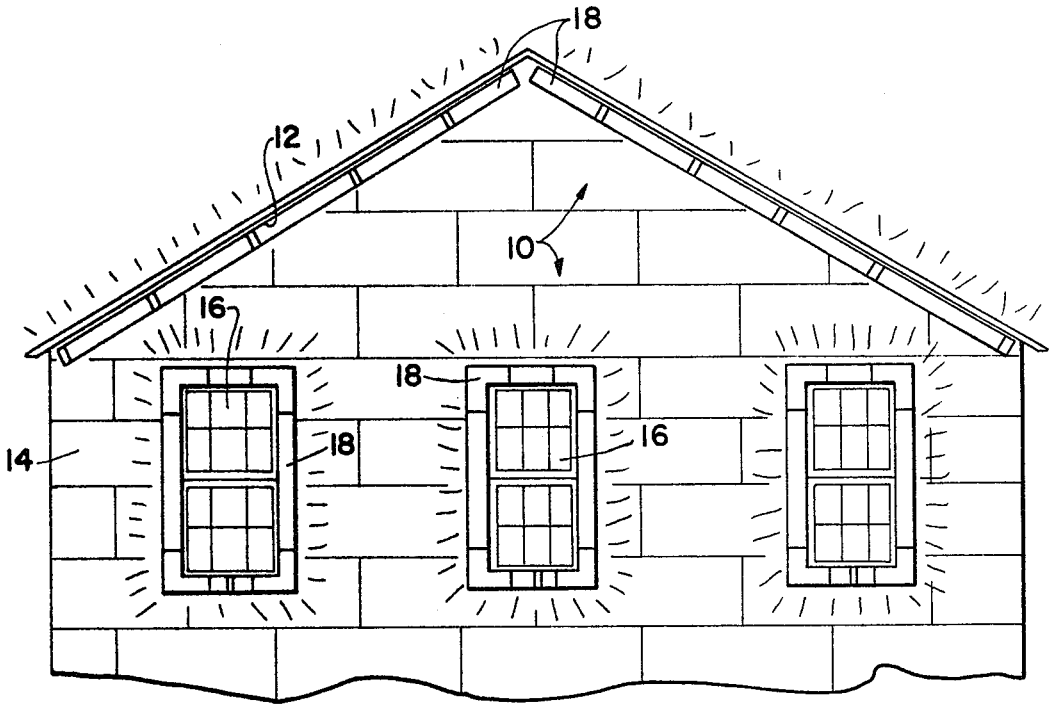
FIG. 1 is a perspective view of the preferred embodiment affixed to a house.

Referring now to the figures, and more particularly to FIG. 1, there is illustrated therein a modular illumination device 10 fixedly secured to the eaves 12 of a house 14 and around the windows 16 thereof. The modular illumination device 10 includes a plurality of rigid hollow illumination housings 18 joined together on the free ends thereof.

Figure 2:
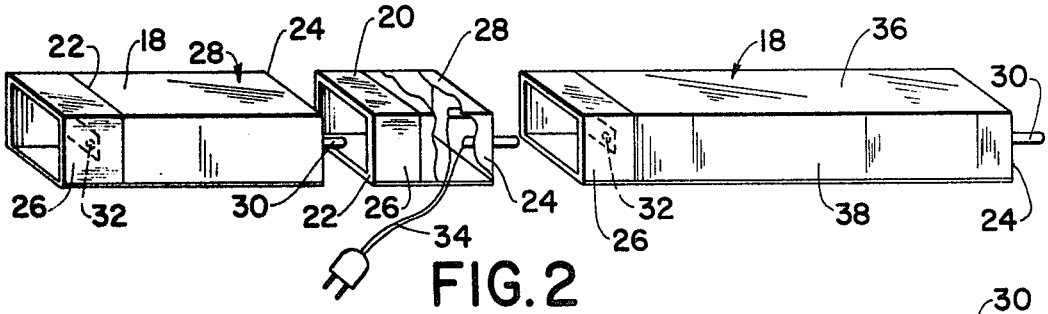
FIG. 2 is a perspective view of the preferred embodiment incorporating the principles of the present invention.

FIG. 2 illustrates a perspective view of a plurality of illumination housings 18 and a power housing 20. The illumination housings 18 and the power housing 20 each have a first free end 22 and a second free ends 24 thereof. A cup like portion 26 is provided on each of the first free ends 22 of the housings 18 and 20. The cuplike portions 26 are dimensioned to capture and to frictionally removedly retain therein the exterior surface 28 of an adjacent second free end 24. Each of the housings 18 and 20 have an electrical plug 30 fixedly secured to the first free ends 22 thereof and a complementary electrical socket 32 fixedly mounted on the second free end 24 thereof. When the housings 18 and 20 are joined the electrical sockets 32 capture and removeably retain therein an adjacent electrical plug 30. A power cord 34 is coupled to the electrical plug 30 of the power housing 20, to couple power thereto. The plurality of illumination housings 18 are constructed of a transparent plastic material and have substantially rectangular cross-sections. The housings may be constructed with only one surface, such as the upper surface 36 or the side surfaces 38 being of a transparent material.

Figure 3:
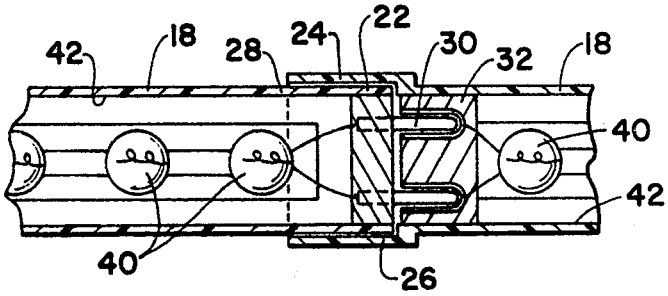
FIG. 3 is a cross-sectional top view of the preferred embodiment.

FIG. 3 illustrates two of the illumination housings 18 joined together. The cup like portion 26 is shown engaging the exterior surface 28 of an adjacent housing 18. The socket 32 is shown electrically connected to the plug 30 of an adjacent housing 18. A plurality of lamps 40 are disposed within each of the chambers 42 respectively formed by the housings 18 and are electrically coupled to the plugs 30 and sockets 32 thereof.

Figure 4:
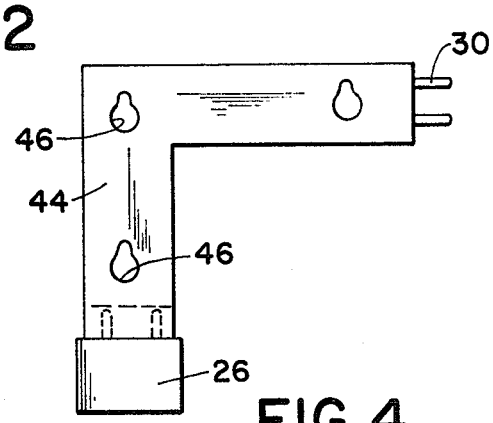
FIG. 4 is a bottom view of a right angle illumination housing of the present invention.

FIG. 4 illustrates a bottom view of a substantially "L" shaped illumination housing 44. The illumination housing 44 has a plurality of substantially keyhole shaped mounting holes 46 located therein. The illumination housing 44 is ideally suited for use around the corners of doors and windows as shown in FIG. 1. Illumination housings may be constructed in various shapes for different installations.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A modular illumination device comprising:

a plurality of rigid hollow illumination housings each forming a chamber therein and having at least one surface thereof permitting the transmission of light therethrough, each of said plurality of said housings having a uniform cross section throughout the length thereof;

affixment means disposed on a first free end of each of said illumination housings, said affixment means for separably joining to a second free end of an adjacent illumination housing, said affixment means having exterior surfaces extending parallel to and contiguous with the exterior surfaces of said illumination housings;

a plurality of incandescent lamps, at least one of said plurality of lamps disposed in each of said chambers of each of said plurality of illumination housings;

electrical coupling means for electrically coupling said plurality of lamps when said plurality of illumination housings are joined, wherein a portion of said electrical coupling means is disposed secured to and housed within said affixment means, the remaining portions of said electrical coupling means located on said second free end of said adjacent illumination housing being disposed within said affixment means when said illumination housing is joined to said adjacent housing; and power coupling means for coupling a power source to said plurality of lamps, said power coupling means having a power coupling housing, said power coupling housing devoid of any illumination source, said power coupling housing having a cross-section along the entire length thereof equivalently dimensioned to said uniform cross-section.

2. A modular illumination device as claimed in claim 1, wherein said affixment means comprises a cup-like portion provided on each of said first free ends, said cup-like portion dimensioned to capture and frictionally removably retain therein the exterior surface of an adjacent said second free end.

3. A modular illumination device as claimed in claim 1, wherein said electrical coupling means comprises a plurality of electrical plugs, one of said plurality of electrical plugs fixedly secured to each of said first free ends of said illumination housings, and a plurality of electrical sockets, one of said plurality of electrical sockets fixedly mounted on each of said second free ends of said illumination housings, said electrical sockets for capturing and removably retaining therein an adjacent said electrical plug of an adjacent cojoined illumination housing.

4. A modular illumination device as claimed in claim 3, wherein said power coupling means comprises said power coupling housing having first and second free ends thereof, respectively, dimensioned to be removably joined with said second and first free ends of a pair of said plurality of illumination housings, said power coupling housing having an electrical plug and socket and a line cord coupled thereto.

5. A modular illumination device as claimed in claim 1, wherein said plurality of illumination housings have a substantially rectangular cross-section.

6. A modular illumination device as claimed in claim 1, wherein at least one of said plurality of illumination housings has the first and second free ends thereof falling in transversely disposed planes.

7. A modular illumination device as claimed in claim 1, wherein each of said illumination housings has a plurality of substantially keyhole shaped mounting holes located therein.

* * * * *